United States Patent [19]

Johnson

[11] 4,009,899

[45] Mar. 1, 1977

[54] WAFER TONGS

[75] Inventor: Douglas M. Johnson, Waconia, Minn.

[73] Assignee: Fluoroware, Inc., Chaska, Minn.

[22] Filed: Oct. 16, 1975

[21] Appl. No.: 623,091

[52] U.S. Cl. ..... 294/33; 81/43; 294/99 R

[51] Int. Cl.[2] ..... B25B 9/02

[58] Field of Search ..... 294/16, 28, 31 R, 33, 294/99 R; 81/43; 128/321, 354; 24/255 TZ

[56] References Cited

UNITED STATES PATENTS

| | | | |
|---|---|---|---|
| 3,140,715 | 7/1964 | Whittow et al. | 128/321 |
| 3,367,336 | 2/1968 | Eizenberg | 81/43 X |
| 3,496,807 | 2/1970 | Jones et al. | 81/43 |
| 3,653,389 | 4/1972 | Shannon | 81/43 X |
| 3,665,790 | 5/1972 | Jones | 81/43 |
| 3,741,602 | 6/1973 | Ploeckelmann | 294/99 R |

*Primary Examiner*—Johnny D. Cherry
*Attorney, Agent, or Firm*—H. Dale Palmatier

[57] ABSTRACT

Wafer tongs for grasping semiconductor wafers and the like are provided with a pair of jaws and at least one wafer-contacting stop limiting the reach of the jaws onto the surface of a wafer from the wafer edge. The stops may take the form of jaw guides which extend from one jaw towards the other to maintain alignment of the jaws. In one embodiment, the guides are carried by a clip movably attached to one jaw for forward or rearward movement thereon to adjust the reach of the jaws onto a wafer. The forward ends of the jaws may be resilient so as to engage and flatten against surfaces of the wafer to improve the grip of the jaws and reduce wafer breakage.

10 Claims, 10 Drawing Figures

FIG. 1
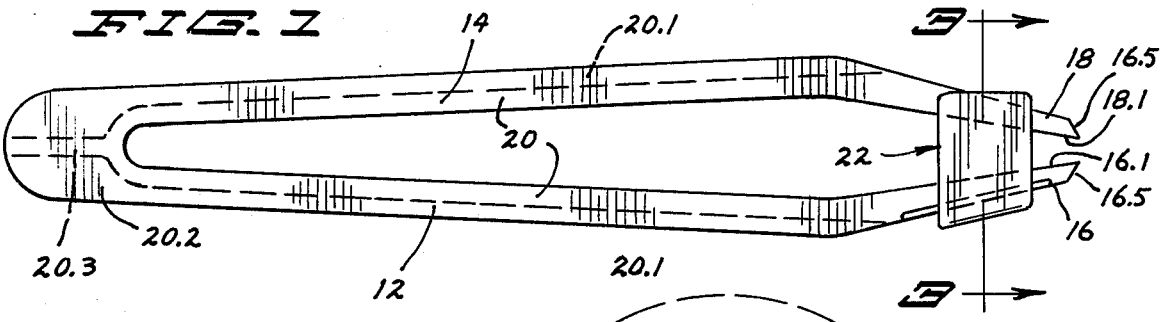
FIG. 2
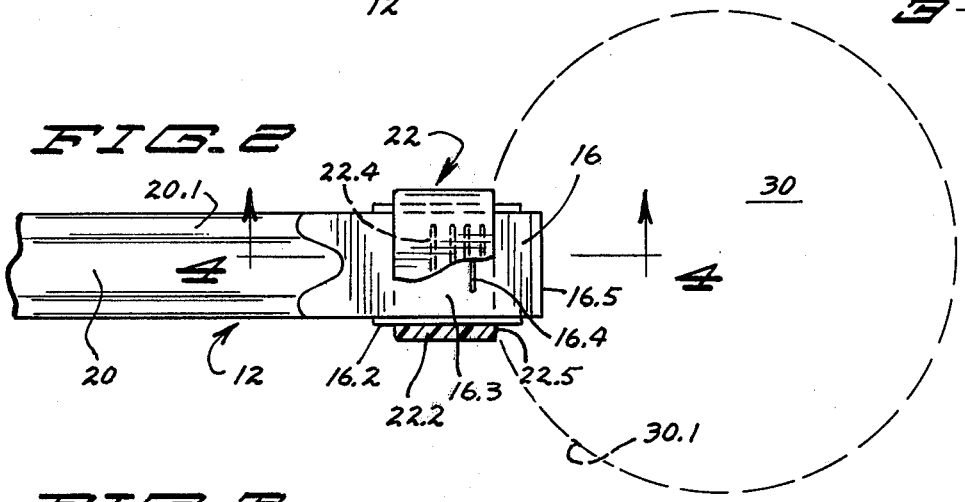
FIG. 3
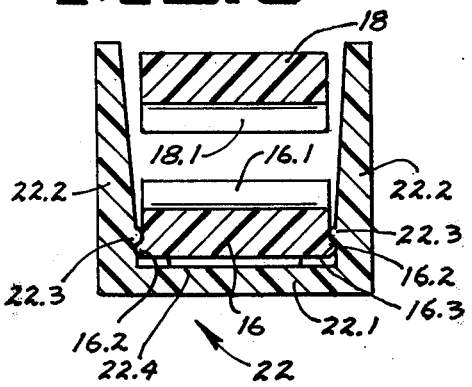
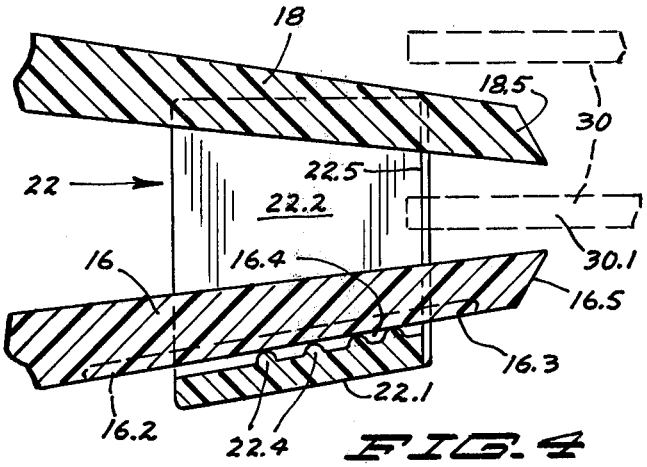
FIG. 4
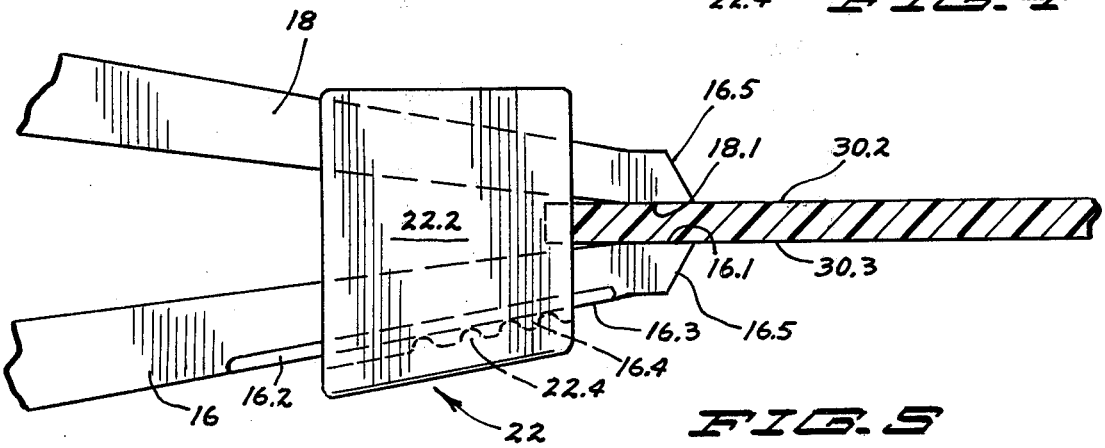
FIG. 5

WAFER TONGS

BACKGROUND OF THE INVENTION

Silicon wafers which are employed in the semiconductor industry are very delicate items which must be handled with extreme care to avoid breakage and further to avoid contamination during processing. Such wafers are ordinarily circular with a diameter of for example, three inches. The thickness of such wafers may be on the order of only several thousandths of an inch. Silicon wafers are often transported through various processing baths by automatic machinery, and may be carried by wafer baskets such as those disclosed in commonly owned Patent Applications Ser. Nos. 504,904 and 504,903, both filed Sept. 11, 1974, now U.S. Pat. Nos. 3,961,877 and 3,923,191, respectively. It is often necessary, however, to manually handle wafers one at a time. To avoid contamination, or breakage, the wafers should not be handled with the fingers nor should they be grasped harshly by, for example, metallic tweezers or the like. Further, wafers should be supported against wobbling or other movement likely to cause breakage when they are handled or transported singly. Finally, the means by which single wafers are grasped should be such as to avoid other than the minimal contact with the flat wafer surfaces so as to avoid contamination or disruption of circuit designs or the like printed on the surfaces of the wafers.

BRIEF SUMMARY OF THE INVENTION

The present invention provides wafer tongs for gently but positively grasping a delicate semiconductor wafer or the like closely adjacent its edge. The tongs include a pair of generally aligned handles terminating forwardly in normally spaced jaws. The jaws have forwardly converging, confronting surfaces for engaging opposed surfaces of a wafer adjacent its edge. A wafer-contacting stop, and desirably a spaced pair of such stops, extend between the jaws to contact the edge of a wafer and thus limit the distance to which the jaws may reach inwardly of the wafer edge.

The stops may take the form of one or more jaw guides carried by one jaw adjacent its end and extending toward the other jaw, and arranged to maintain alignment between the jaws as they move into grasping engagement with a wafer. One such guide may comprise a pin extending from one jaw and passing through an aligned hole in the other jaw, the forward edge of the pin serving as a wafer-contacting stop. In another embodiment, one jaw is provided with a pair of spaced ears extending from its sides and passing on either side of the other jaw to guide the latter. The forward edges of the ears serve as spaced stops which may have curved, wafer-contacting surfaces to engage the curved wafer edge. Each of the pair of stops contacts the wafer, and the wafer is thus restrained from swinging from side to side in the jaws.

In an important embodiment, a pair of guide ears as described above extend from a guide clip which is adjustably mounted to one jaw to permit the clip to be adjusted forwardly or rearwardly to vary the reach of the jaws inwardly of a wafer edge.

The forward ends of the jaws desirably are resilient so as to engage and flatten their normally converging confronting surfaces against opposed wafer surfaces to thereby provide gentle surface-to-surface contact of the jaws with the wafer. The possibility of wafer breakage by the jaws is thereby reduced, and the water is restrained from swinging in the jaws from side to side.

BRIEF SUMMARY OF THE DRAWING

FIG. 1 is a side elevation of wafer tongs of the invention;

FIG. 2 is a broken away bottom view, in partial cross section, of the tongs of FIG. 1, with the position of a semiconductor wafer shown in phantom lines;

FIG. 3 is a cross-sectional view taken along line 3—3 of FIG. 1;

FIG. 4 is a broken away, cross-sectional view taken along line 4—4 of FIG. 2;

FIG. 5 is a broken away elevational view of the tongs of FIG. 1 shown in position holding a semiconductor wafer;

DETAILED SPECIFICATION

Figure 6:
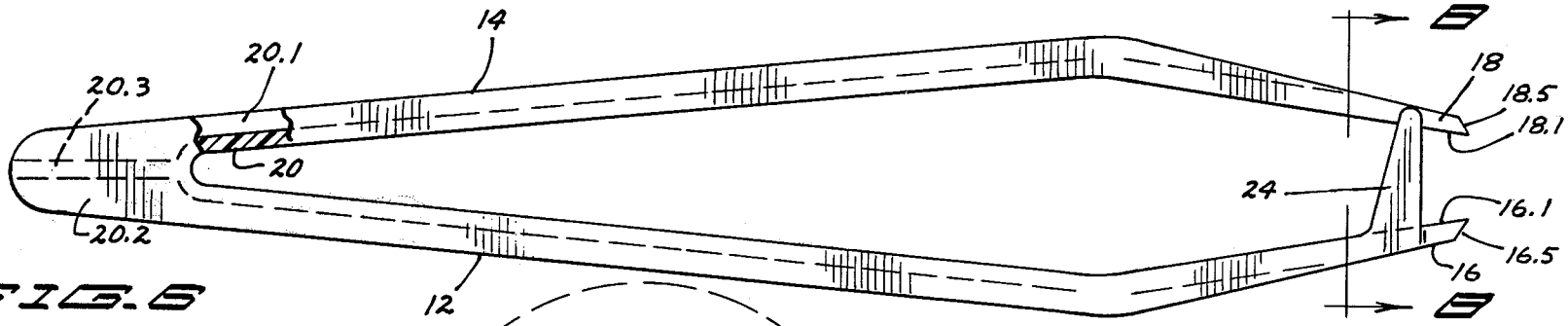
FIG. 6 is an elevational view, in partial cross section, of another embodiment of the tongs of the invention.

The embodiment of the invention shown in FIGS. 1–5 includes a pair of generally aligned handles 12, 14 and extending forwardly to terminate in jaws 16, 18 respectively. The handles and jaws are desirably provided as an integral, single molded piece comprising a strap 20 bent into an elongated U orientation and having elongated, outwardly extending ribs 20.1 along its longitudinal edges, the width of the rib being wider at the rearward end of the tongs as shown at 20.2 in FIG. 1. The strap includes a rearwardly extending portion 20.3 serving to support the ribs 20.2. Adjacent their forward ends, the straps are bent slightly to converge forwardly, with the ribs 20.1 terminating a short distance forward of the last-mentioned bends.

The jaws 16, 18 formed by the forwardly converging ends of the handles, have forwardly converging inner surfaces 16.1, 18.1 which, in use, confront and engage opposed surfaces of a semiconductor wafer.

Referring particularly to FIGS 2–5 the jaw 16 is provided with a clip designated generally as 22. The clip has a bottom wall 22.1 from the edges of which arise identical side walls 22.2, providing the clip with a generally U-shaped configuration and cross section as shown best in FIG. 3. The internal surfaces of the side walls 22.2 are provided adjacent their juncture with the bottom wall with longitudinal inwardly projecting lips 22.3. The upper surface of the bottom wall 22.1 is provided with spaced, transverse ribs 22.4. The edges of the lower jaw 16 are provided with outwardly extending lips 16.2 which pass underneath the lips 22.3 of the clip, as shown best in FIG. 3, so that the clip is retained in sliding fashion upon the lower jaw 16. The outer surface 16.3 of the lower jaw is provided with a transverse rib 16.4 (best seen in FIG. 4) which is received between the ribs 22.4 of the clip. In this manner, as the clip is moved forwardly or rearwardly of the lower jaw with the lips 16.2, 22.3 of the jaw and clip in sliding contact, the rib 16.4 of the jaw slides into the grooves or valleys between succeeding ribs 22.4 of the clip in detent fashion so that the clip may be adjusted forwardly or rearwardly of the jaw and, when the proper orientation has been obtained, the clip will be held against accidental forward or rearward movement by the coacting ribs 16.4, 22.4.

The upright "ears," or side walls 22.2 of the clip extend on either side of the other jaw 18 so as to maintain the alignment of that jaw with the lower jaw 16 as the jaws are closed, as will be described more fully below. Moreover, the forward-facing surfaces 22.5 of the ears or side walls 22.2 of the clip are arcuate in cross section, as best seen in FIGS. 2 and 4, and provide wafer-contacting stops. The forward-facing arcuate surfaces of the stops are formed with approximately the same radius as that of the wafer to be grasped so that the curved edges of the wafer abut the arcuate surfaces of the stops in surface-to-surface contact. This feature is shown most clearly in FIG. 2 in which a wafer 30 (shown in phantom lines) with a curved, peripheral edge 30.1 is held in the tongs with the curved edge 30.1 abutting the arcuate, forward-facing surface 22.5 of the clip ears or side walls 22.2.

The tongs of the invention desirably are made of a resilient plastic material such as "Teflon" PFA Fluorocarbon resin, which is a perfluoroalkoxy-subsituted polytetrafluoroethylene-type resin sold by the DuPont Company. The forward end portions of the jaws 16, 18 have a thickness sufficiently small (e.g., 0.062 inches or about 1.6 mm) as to resiliently yield when the jaws are contacted with a wafer. The normally converging inner surfaces 16.1, 18.1 of the forward ends of the jaws flatten themselves against the opposed surfaces 30.2, 30.3 of the wafer (FIG. 5) so that the wafer is held in surface-to-surface contact with the jaws (as distinguished from point-to-point or line-to-line contact). As a result, the manual force which clamps the jaws together is distributed over the jaw-engaged surface of the wafer (as contrasted with the force being concentrated at a point or line), and the wafer is thus held gently but firmly in the tongs and is prevented from swinging from side to side. The contact of the wafer edge 30.1 with the stops 22.5 of the clip further restrains side-to-side swinging of the wafer. As will now be further understood, the stops 22.5 limit the forward reach of the jaws 16, 18 inwardly of the wafer edge to thereby prevent the often delicately designed central area of the wafer from being contacted by the jaws and limiting jaw contact to a narrow peripheral area of the wafers.

The tongs of the invention are quite small and are adapted for meticulous and careful manual manipulation. For example, the tongs may have a length of about 4¾ inches (about 12 cm), and the width of the jaws may be on the order of 0.44 inches (about 11 mm). When unstressed, the jaws may have a separation from one another of approximately ⅝ inch (about 16 mm). The inner surfaces 18.1, 16.1 of the forward ends of the jaws normally converge forwardly at an angle to each other of approximately 10°, and as will be noted from FIGS. 1, 4 and 5, the forward ends of the jaws have forwardly convergent, tapered surfaces 16.5, 18.5 so as to reduce the thickness of the forward ends of the jaws and permit these ends more easily to flatten in surface contact with a wafer.

From the above description, it will be understood that only very slight manual pressure need be expended to bring the jaws together and flatten their inner surfaces into grasping contact with a wafer. Moreover, the small dimensions of the jaws permit them to reach into a basket or the like of axially aligned wafers 30 (FIG. 4) and to grasp and remove a single wafer therein without disturbing the other wafers.

Figure 7:
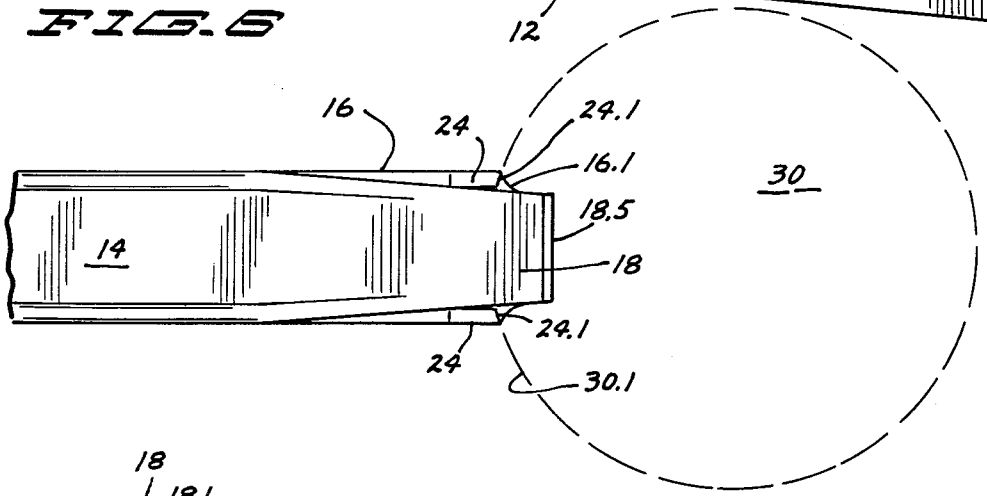
FIG. 7 is a broken away top view of the tongs of FIG. 6 with the position of a semiconductor wafer shown in phantom lines.
Figure 8:
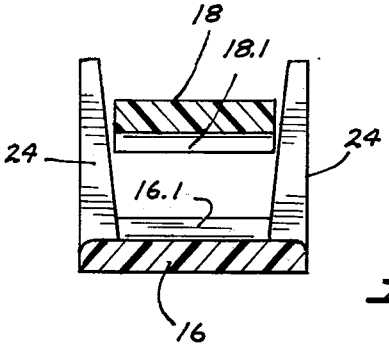
FIG. 8 is a cross-sectional view taken along line 8—8 of FIG. 6.

The embodiment of the tongs shown in FIGS. 6–8 is similar to that of FIGS. 1–5, and the same numerals have been used to designate identical parts such as the handles 12, 14 and the jaws 16 and 18. In the embodiment of FIGS. 6–8, the side edges of the upper jaw 18 converge forwardly slightly, as shown best in FIG. 7. A pair of ear-shaped stops, designated generally as 24, arise from the bottom jaw 16 adjacent but spaced from the jaw end, the stops passing upwardly adjacent the converging side edges of the upper jaw 18 (FIG. 8). The forward edges 24.1 of the stops 24 are arcuate in cross section, as shown in FIG. 7, and are formed with radii of curvature approximately equal to that of a wafer 30 so as to engage the edge 30.1 of the wafer in surface-to-surface contact in the same manner as do the stop edges 22.5 in the embodiment of FIGS. 1–5. From its junctures with the stops 24, the lower jaw arcuately converges forwardly as shown in FIG. 7 and terminates forwardly in a jaw end of approximately the same width as the upper jaw 18.

Although the stops 24 of the embodiment of FIGS. 6–8 are not adjustable forwardly or rearwardly of the jaws, this embodiment has the advantage of being of unitary construction and may be molded relatively inexpensively as a single unit.

Figure 9:
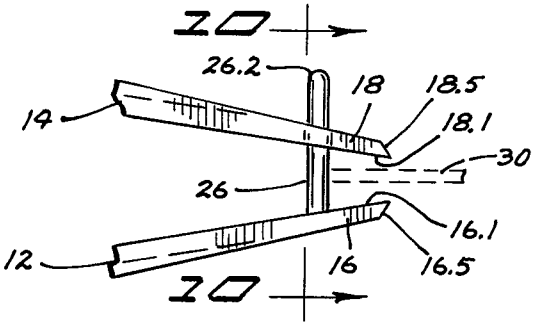
FIG. 9 is a broken away elevational view of yet another embodiment of the tongs of the invention with a position of a semiconductor wafer shown in phantom lines.
Figure 10:
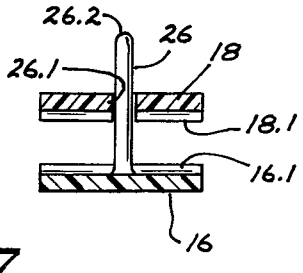
FIG. 10 is a cross-sectional view taken along line 10—10 of FIG. 9.

The embodiment shown in FIGS. 9 and 10 has handles and jaws which are the same as those of the embodiments of FIGS. 1–5 and 6–8, and are given similar reference numerals. In the embodiment of FIGS. 9 and 10, however, only a single stop is employed and takes the form of a pin 26 arising from the bottom jaw 16 near its forward end and extending upwardly through an aligned hole 26.1 formed centrally of the upper jaw 18 to maintain side-to-side alignment of the jaws as they are squeezed together to grasp a wafer. The upper end 26.2 of the pin is rounded or pointed for easy insertion in the hole 26.1. The forward edge of the pin 26 serves as a stop to contact a wafer 30 and limit the reach of the jaws 16, 18 inwardly of the wafer, in the manner described above with reference to other embodiments. Although the stop in this embodiment is not adjustable forwardly or rearwardly of the jaws, as in the embodiment of FIGS. 1–5, nor provides two spaced points of contact with a wafer as in the previous embodiments, this embodiment has the advantage of providing excellent jaw alignment together with a narrow jaw width.

In use, and referring again to the embodiment of FIGS. 1–5, the clip 22 is first adjusted along the lower jaw 16 so that the forward jaw ends protrude a predetermined distance forwardly of the clip. This distance is, of course, determined by the available width of the periphery of the wafer which can be allowed to come into contact with the jaws. For a wafer 3 inches in diameter, for example, the distance which the jaws may be permitted to reach inwardly of the wafer edge may be on the order of 3/16 inch (about 5 mm). As the clip is moved forwardly or rearwardly on the lower jaw, the rib 16.4 steps into successive valleys or grooves between the ribs 22.4 of the clip, and when the clip is then moved to its desired location, the coaction of the ribs 16.4 and 22.4 retain the clip in place against accidental movement. The tongs are then grasped to permit squeezing of the handles, and the jaws are carefully moved into position with a wafer as shown in FIG. 4 with the arcuate, forward facing surfaces 22.5 of the clip side walls or stops in surface contact with the edge 30.1 of the wafer. Slight squeezing pressure is applied to the tongs to close the jaws upon the wafer, even slight pressure being sufficient to permit the forward ends of the jaws to resiliently bend slightly so as to flatten their inner surfaces 16.1, 18.1 against the opposed surfaces of the wafer, as shown in FIG. 5. The wafer is hence supported on its flat surfaces by surface-to-surface contact with the jaws, and is also supported at its edge by surface-to-surface contact with the arcuate edges of the stops. In this position, the wafer is gently but firmly held in the tongs and is prevented from swinging from side to side. If the squeezing pressure on the tong handles is increased beyond that normally required, the forward ends of the jaws merely further resiliently bend to extend the area of contact between the jaws and the wafer, without causing damage to the wafer. When the wafer has been moved to its intended position, the jaws are disengaged from the wafer simply by releasing the sqeezing pressure on the tong handles.

Substantially the same procedure for use is applicable to the embodiment of FIGS. 6–8, except that no preliminary adjustment of the stops is made. As the handles are squeezed together, the ears or stops 24 rising from the bottom jaw 16 pass on either side of the top jaw 18. The stops 24 are moved into contact with the wafer edge with the arcuate, forward facing edges 24.1 of the stops coming into surface-to-surface contact with the edge 30.1 of the wafer. As the wafer is grasped, the forward ends of the jaws bend resiliently so that the inner surfaces 16.1, 18.1 of the jaws come into surface-to-surface contact with the opposed flat surfaces of the wafer. The wafer is restrained from swinging from side to side in the tongs by virtue of the surface-to-surface contact between the jaws and the flat surfaces of the wafer, and also by the spaced point contact of the wafer edge 30.1 with the stops 24.

The embodiment of FIGS. 9 and 10 is employed to similarly grasp a wafer, except that no adjustment of the stop 26 is required. The stop 26 serves, as above, not only to align the jaws of the tongs, but also to limit the distance to which the jaws reach beyond the edge of a wafer. Again, the forward ends of the jaws bend resiliently to provide surface-to-surface contact with the flat, opposed surfaces of the wafer.

Thus, I have provided wafer tongs which are capable of gently but firmly grasping a wafer at its periphery. The stops which are employed serve not only to limit the distance to which the jaws reach beyond the edge of a wafer, but also maintain alignment between the jaws as they are closed upon a wafer. The resilient nature of the forward ends of the jaws, which permit the jaws to flatten into surface-to-surface contact with opposed flat surfaces of the wafer, avoids possible damage to the wafer which might occur from point-to-point or line-to-line contact between the jaws and the wafer. Moreover, excessive squeezing pressure which may be accidentally applied to the handles of the tongs does not operate to break the wafer, but rather causes the ends of the jaws to bend resiliently and to increase the area of surface-to-surface contact between the jaws and the wafer.

While I have described preferred embodiments of the present invention, it should be understood that various changes, adaptations, and modifications may be made therein without departing from the spirit of the invention and the scope of the appended claims.

What is claimed is:

1. Wafer tongs for gently but firmly grasping a delicate semiconductor wafer or the like, and comprising a pair of molded plastic resiliently joined handles terminating forwardly in normally spaced jaws arranged to grasp a wafer therebetween, the jaws having forwardly converging, confronting inner surfaces, an elongate stop carried by one of the jaws adjacent but spaced from its forward end and extending transversely of the jaws and entirely across the space between the jaws in position to contact the edge of a wafer to be grasped and to limit the distance to which the jaws may reach inwardly of the wafer edge, the elongate stop being in non-interfering relation with the other jaw to permit wide separation of the jaws, and the jaws being resiliently flexible at a location forwardly of the stop to bow and resiliently flatten against opposed wafer surfaces to provide surface-to-surface contact of the jaws with the wafer to distribute the grasping force of the jaws over a significant area of the wafer.

2. The wafer tongs of claim 1 wherein the stop extends from the one jaw into guiding orientation with the other jaw to maintain the jaws in alignment as they close upon a wafer.

3. The wafer tongs of claim 2 wherein the stop comprises a pair of spaced guides extending from the side edges of one jaw adjacent its tip end into guiding orientation with the edges of the other jaw, forward edges of the guides providing transversely aligned and spaced stop surfaces contactable with a wafer at spaced positions about the wafer periphery to restrain the wafer from swinging from side to side in the jaws.

4. The wafer tongs of claim 3 wherein the inner surfaces of the jaws are substantially smooth.

5. The wafer tongs of claim 2 in which the stop comprises a pin extending from one jaw adjacent to but spaced from its forward end and oriented to pass through a guide hole in the other jaw with the pin and guide hole being oriented to continuously maintain alignment of the jaws as the latter are closed upon a wafer.

6. Wafer tongs for gently but firmly grasping a delicate semiconductor wafer or the like and comprising a pair of resiliently joined handles terminating forwardly in normally spaced jaws arranged to grasp a wafer therebetween with the jaws in respective contact with opposed, flat wafer surfaces adjacent the edge of the wafer, and a clip attached to one jaw and slidably positionable forwardly and rearwardly of that jaw, the clip having side walls on either side of the jaw and defining spaced guides extending from the edges of that jaw adjacent its end into guiding orientation with the edges of the other jaw, forward edges of the guides providing transversely aligned and spaced stop surfaces contactable with a wafer at spaced positions about the wafer periphery to restrain the wafer from swinging from side-to-side in the jaws, whereby adjustment of the clip and its side walls forwardly or rearwardly of the jaw adjusts the distance to which the jaws may reach inwardly of the edge of a wafer to be grasped.

7. Wafer tongs for gently but firmly grasping a delicate semiconductor wafer or the like and comprising a pair of resiliently joined handles terminating forwardly in aligned, normally spaced jaws having forwardly converging, confronting inner surfaces, the forward ends of the jaws having sufficient resilience to engage and resiliently flatten against opposed wafer surfaces to provide surface-to-surface contact of the jaws with the wafer; and a clip attached to one jaw and slideably positionable forwardly and rearwardly of the jaw, the clip having side walls on either side of the jaw and extending into guiding proximity with the sides of the opposed jaw to maintain alignment between the jaws as the latter are closed upon a wafer, the side walls of the clip having forwardly facing, arcuate surfaces defining spaced stops engageable with the curved edges of a wafer when the latter is received between the jaws to thereby limit the distance to which the jaws may reach inwardly of the wafer edge, the clip and the jaw to which it is attached having respective guides to guide the clip longitudinally of the jaw, and further having detent means to releaseably position the clip longitudinally of the jaw at a desired position to thereby permit adjustment of the distance to which the jaws may reach inwardly of the wafer edge.

8. Wafer tongs for gently but firmly grasping a delicate semiconductor wafer or the like and comprising a pair of resiliently joined handles terminating forwardly in aligned and normally spaced jaws having forwardly converging and confronting inner surfaces, one of the jaws having a pair of spaced guides adjacent to but spaced from its forward tip end and extending from the sides of the jaw entirely across the space between the jaws and into guiding proximity with the sides of the opposed jaw to thereby maintain alignment between the jaws as the latter close upon a wafer, the guides having forward-facing surfaces oriented to engage the curved edge of a wafer and to limit the distance to which the jaws may reach inwardly of the wafer edge, the jaws being resiliently flexible at a location forwardly of said guides to bow and resiliently flatten against opposed wafer surfaces to provide surface-to-surface contact of the jaws with the wafer, the surface-to-surface contact of the jaws with the flat wafer surfaces distributing the pressure of the jaws over a significant area to avoid wafer breakage, and further coacting with the stops to restrain side-to-side movement of the wafer in the jaws.

9. The wafer tongs of claim 8 in which the tongs are of resilient plastic with the handles, jaws and guides being parts of an integral, molded unit.

10. Wafer tongs for gently but firmly grasping a delicate semiconductor wafer or the like, and comprising a pair of resiliently joined handles terminating forwardly in normally spaced jaws arranged to grasp a wafer therebetween with the jaws in respective contact with opposed, flat wafer surfaces adjacent the edge of the wafer, and a clip attached to one jaw and slideably positionable forwardly and rearwardly of that jaw, the clip including spaced guides extending into guiding orientation with the other jaw, the guides having forward edges contactable with a wafer at spaced positions about the wafer periphery to restrain the wafer from swinging from side-to-side in the jaws, whereby adjustment of the clip forwardly or rearwardly adjusts the distance to which the jaws may reach inwardly of the edge of a wafer.

* * * * *